US012601552B2

(12) United States Patent
Wilkinson et al.

(10) Patent No.: US 12,601,552 B2
(45) Date of Patent: Apr. 14, 2026

(54) RELATING TO RADIATOR GUARDS

(71) Applicant: Perkins Engines Company Limited, Peterborough (GB)

(72) Inventors: Paul William Wilkinson, Peterborough (GB); Shankar Raman, Adambakkam Chennai (IN); Nalraj Pandi, Sengundrapuram Virudhunagar (IN)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 18/918,986

(22) Filed: Oct. 17, 2024

(65) Prior Publication Data

US 2025/0146769 A1 May 8, 2025

(30) Foreign Application Priority Data

Nov. 6, 2023 (GB) ..... 2316990

(51) Int. Cl.
*F28F 19/00* (2006.01)
*B60L 11/04* (2006.01)
*B60R 19/52* (2006.01)

(52) U.S. Cl.
CPC ..... *F28F 19/002* (2013.01); *F28F 2265/02* (2013.01)

(58) Field of Classification Search
CPC .... F28F 18/002; F28F 2265/02; F28F 19/002; B60R 19/52; B60R 2019/525; B60L 11/04
See application file for complete search history.

(56) References Cited

U.S. PATENT DOCUMENTS

| | | | | |
|---|---|---|---|---|
| 1,609,884 | A * | 12/1926 | Priore | A47G 5/04 237/79 |
| 4,131,172 | A * | 12/1978 | Wolfgram | B62D 25/10 16/221 |
| 4,634,346 | A | 1/1987 | Cameron et al. | |
| 7,946,781 | B2 * | 5/2011 | Mudel | F16B 41/002 411/103 |
| 10,161,101 | B2 | 12/2018 | Nishiguchi et al. | |
| 10,400,423 | B1 * | 9/2019 | Beasley | E02F 3/7618 |
| 2011/0272967 | A1 * | 11/2011 | Davisdon | B60R 19/52 165/104.34 |

FOREIGN PATENT DOCUMENTS

| | | | | |
|---|---|---|---|---|
| EP | 1867943 | A1 * | 12/2007 | F28F 9/002 |
| JP | 2004218510 | A | 8/2004 | |
| JP | 2016043904 | A | 4/2016 | |
| JP | 6907736 | B2 | 7/2021 | |

OTHER PUBLICATIONS

Great Britain Search Report related to Application No. GB2316990.7 reported on May 2, 2024.

* cited by examiner

*Primary Examiner* — Grant Moubry

(57) ABSTRACT

A radiator guard comprising a main body and a service panel; the main body being formed of mesh sheet material and comprising: a plurality of fastening points for mounting the main body over a rear face of a radiator of an internal combustion engine; a service aperture for providing access, in use, to the rear face of the radiator; and a plurality of retained fasteners arranged around a periphery of the service aperture; wherein the service panel is releasably mountable to the main body, to cover the service aperture, using the retained fasteners.

20 Claims, 5 Drawing Sheets

RELATING TO RADIATOR GUARDS

CROSS-REFERENCE TO RELATED APPLICATION

This application claims priority under 35 USC § 119 and the Paris Convention to Great Britain Patent Application No. 2316990.7 filed on Nov. 6, 2023.

TECHNICAL FIELD

The present disclosure relates to improvements in or relating to radiator guards. In particular, it relates to a radiator guard, an internal combustion engine assembly, and a method of forming a radiator guard.

BACKGROUND TO THE DISCLOSURE

An internal combustion engine assembly may comprise an engine block, a fan and a radiator. A radiator guard may be provided to guard rotating components, for example fan blades of the fan. Servicing and maintenance of the radiator, fan or other components of the internal combustion engine assembly may require the radiator guard to be dismounted. The internal combustion engine assembly may comprise additional components, for example conduits, e.g. cooling circuit conduits, that extend across and in proximity to the radiator guard when mounted. This may then require the disassembly and removal of the conduits before the radiator guard may be removed. In turn this may require the draining of one or more fluid systems, e.g. the cooling circuit. This may result in lost time, and additional inconvenience and expense when performing servicing or maintenance of the internal combustion engine assembly.

SUMMARY OF THE DISCLOSURE

An embodiment of the present disclosure provides a radiator guard comprising a main body and a service panel;

the main body being formed of mesh sheet material and comprising:

a plurality of fastening points for mounting the main body over a rear face of a radiator of an internal combustion engine;

a service aperture for providing access, in use, to the rear face of the radiator; and a plurality of retained fasteners arranged around a periphery of the service aperture;

wherein the service panel is releasably mountable to the main body, to cover the service aperture, using the retained fasteners.

Another embodiment of the present disclosure provides an internal combustion engine assembly, comprising:

an engine block a fan a radiator and a radiator guard;

the radiator guard comprising a main body and a service panel;

the main body being formed of mesh sheet material and comprising:

a plurality of fastening points for mounting the main body over a rear face of the radiator;

a service aperture for providing access, in use, to the rear face of the radiator; and a plurality of retained fasteners arranged around a periphery of the service aperture;

wherein the service panel is releasably mountable to the main body, to cover the service aperture, using the retained fasteners.

Another embodiment of the present disclosure provides a method of forming the radiator guard of the above embodiment, comprising:

forming a net of mesh sheet material, the net comprising the service aperture;

folding and optionally welding the net to form at least a part of the main body of the radiator guard;

attaching a plurality of retained fasteners around a periphery of the service aperture;

forming the service panel of mesh material; and mounting the service panel to the at least a part of the main body using the plurality of retained fasteners.

BRIEF DESCRIPTION OF THE DRAWINGS

One or more embodiments of the disclosure will now be described, by way of example only, with reference to the accompanying drawings in which.

DETAILED DESCRIPTION

Unless defined otherwise, all technical and scientific terms used in this specification have the same meaning as is commonly understood by the reader skilled in the art to which the claimed subject matter belongs. It is to be understood that the foregoing summary of the disclosure and the following examples are exemplary and explanatory only and are not restrictive of any subject matter claimed.

The following description is directed to embodiments of the disclosure. The description of the embodiments is not meant to include all the possible embodiments of the disclosure that are claimed in the appended claims. Many modifications, improvements and equivalents which are not explicitly recited in the following embodiments may fall within the scope of the appended claims. Features described as part of one embodiment may be combined with features of one or more other embodiments unless the context clearly requires otherwise.

In this specification, the use of the singular includes the plural unless the context clearly dictates otherwise. In this application, the use of "and/or" means "and" and "or" unless stated otherwise.

The present disclosure relates generally to a radiator guard 1 comprising a main body 10 and a service panel 50. A first embodiment of the radiator guard 1 is shown in FIGS. 1 to 5.

Figure 5:
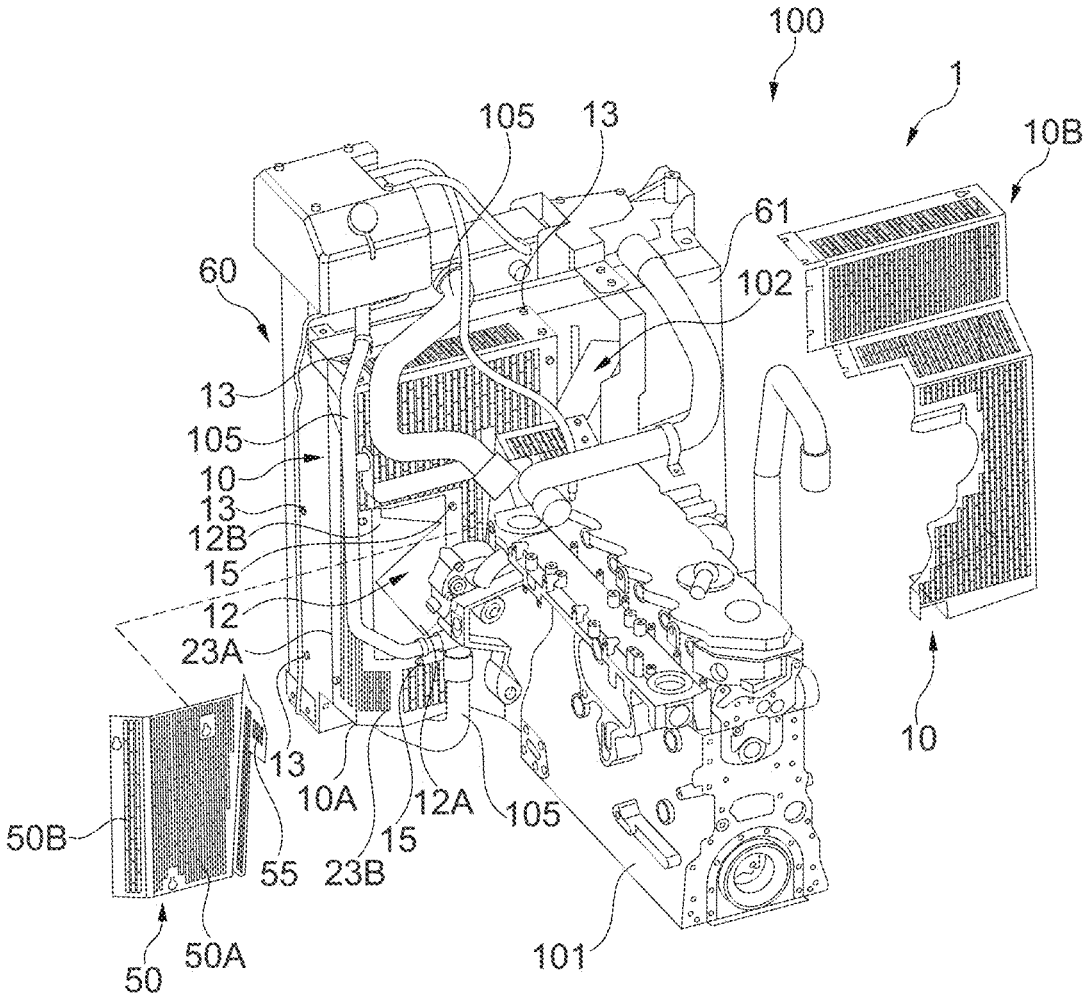
FIG. 5 is a perspective view of an internal combustion engine assembly according to the present disclosure.

The main body 10 may comprise separate first and second parts 10A, 10B that can be mounted, in use, adjacent one another over a rear face 61 of a radiator 60 as shown in FIG. 5. The first part 10A and the second part 10B may be individually dismountable. Alternatively, the main body 10 may comprise a single part.

A service aperture 12 for providing access, in use, to the rear face of the radiator 60 is provided in the main body 10, optionally in the first part 10A of the main body 10.

The main body 10 is formed of mesh sheet material and comprises a plurality of fastening points 13 for mounting the main body 10 over the rear face 61 of a radiator of an internal combustion engine.

The service panel 50 may also be formed of mesh sheet material.

The mesh sheet material of the main body 10 and/or the service panel 50 may be an open slotted mesh sheet material. The material openings may be sized and shaped to meet the requirements of Table 4 of EN ISO 13857. For example, the mesh sheet material may comprise a perforated slot pattern. The perforated slot pattern may comprise 8 mm×48 mm slots with a separation of 4 mm between slots ends and between adjacent rows.

The mesh sheet material may have a material thickness of 1.0 to 2.0 mm, optionally of 1.6 mm.

A plurality of retained fasteners 15 are arranged around a periphery of the service aperture 12. The retained fastener 15 permits the service panel 50 to be mounted and dismounted from the main body 10 while the retained fastener 15 remains associated, e.g. connected, to the main body 10.

Figure 10:
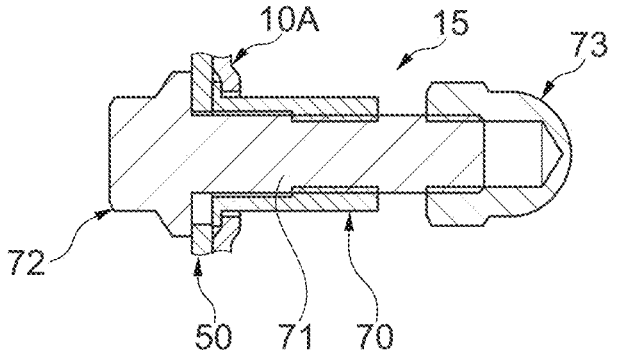
FIG. 10 is a cross-sectional view of a retained fastener of the present disclosure.

An example of a retained fastener 15 is shown in cross-section in FIG. 10. The retained fastener 15 may comprise a threaded insert 70 that is fixedly mounted to the first part 10A of the main body 10 by a suitable means, for example by welding. A threaded bolt 71 of the retained fastener 15 may be received in the threaded insert 70. At one end the threaded bolt 71 may comprise a flange head 72 and at the other end a domed nut 73 may be attached and optionally in a fixed manner by application to the threads of glue or other fixing agent. In use, the service panel 50 may be mounted to the main body 10 by loosening the threaded bolt 71 from the threaded insert 70 by acting on the flange head 72 to rotate the threaded bolt 71 and thereby space the flange head 72 from the threaded insert 70. The flange head 72 may then be passed through a key-shaped slot in the service panel 50 so that the threaded bolt 71 can be engaged in a narrowed section of the key-shaped slot. The threaded bolt 71 may then be tightened by acting on the flange head 72 to sandwich the service panel 50 between a rear face of the flange head 72 and the face of the threaded insert 70 and/or the main body 10. Throughout, the presence of the domed nut 73 may prevent over-loosening of the threaded bolt 71 preventing it becoming detached from the threaded insert 70, thereby ensuring that the retained fastener 15 does not become detached from the main body 10.

FIGS. 1 to 4 illustrate a first part 10A of the main body of the radiator guard 1. The service panel 50 may be mountable to this first part 10A to form an assembly. The second part 10B (illustrated in FIG. 5 may or may not be provided with its own service panel for mounting thereto).

The main body 10 may comprise a rear face, a top wall, a bottom wall, and at least one side wall. Where the main body 10 is a single part the main body 10 may comprise two side walls. Where the main body 10 comprises separate first and second parts, each part may comprise a single side wall.

Figure 1:
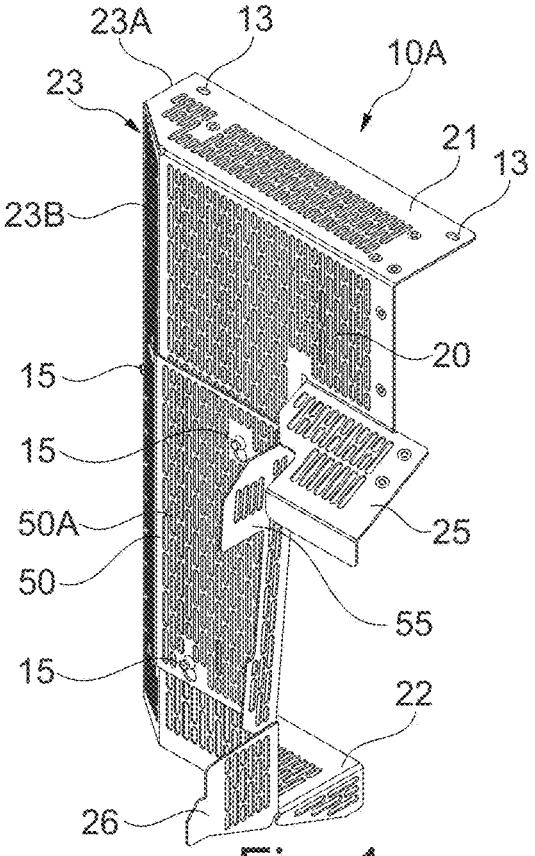
FIG. 1 is a perspective view of an assembly of a first part of a main body of a radiator guard and a service panel according to the present disclosure.
Figure 2:
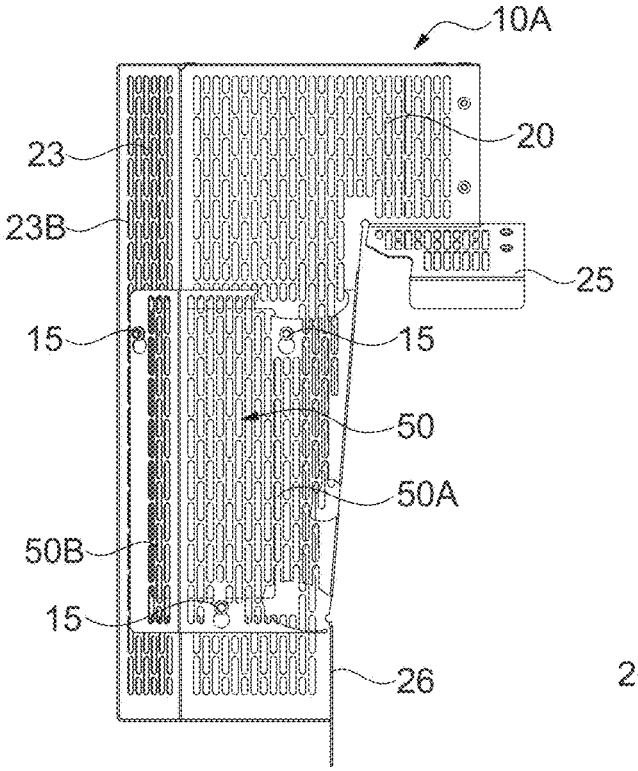
FIG. 2 is a rear view of the assembly of FIG. 1.
Figure 3:
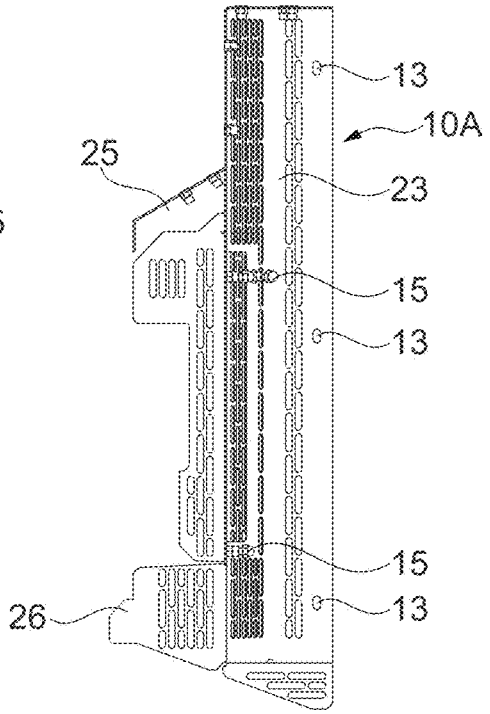
FIG. 3 is a side view of the assembly of FIG. 1.

In the illustrated example of FIGS. 1 to 3, the first part 10A of the main body 10 comprises a rear face 20, a top wall 21, a bottom wall 22, and a side wall 23.

The top face 21 and/or the bottom face 22 may be planar. The rear face 20 may be planar. The side wall 23 may comprise a perpendicular first face 23A angled perpendicularly to the rear face 20 and a canted second face 23B that is canted relative to the rear face 20 and the first face 23A.

The service aperture 12 may encompass a rear face aperture 12A in the rear face 20 and a side wall aperture 12B in the side wall 23.

The service panel 50 may comprise a rear face portion 50A that may be releasably mountable over the rear face aperture 12A and a side wall portion 50B that may be releasably mountable over the side wall aperture 12B.

The rear face aperture 12A and the side wall aperture 12B may consist of a single aperture.

The side wall aperture 12B may be in the canted second face 23B and the side wall portion 50B of the service panel 50 may be canted relative to the rear face portion 50A.

At least one of the retained fasteners 15 may be located on the canted second face 23B and at least one, optionally at least two, retained fastener(s) 15 may be located on the rear face 20.

The first part 10A of the main body 10 may comprise one or more additional extensions. For example, as shown in FIGS. 1 to 3, one or more lateral flanges may extend from an edge of the rear face 20. The lateral flange(s) may extend perpendicular to the rear face 20 or an at angle to the rear face 20. The lateral flange(s) may extend from the rear face 20 in the opposite direction to the direction of extension of the side wall 23 from the rear face 20. A first lateral flange 25 may form a roof structure to guard against access from above. A second lateral flange 26 may form a wall structure to guard against access from the side.

The service panel 50 may also comprise a lateral flange 55. The lateral flange 55 may extend perpendicular to the rear face portion 50A. The lateral flange 55 may extend from the rear face portion 50A generally in the opposite direction to the direction of extension of the side wall portion 50B from the rear face portion 50A.

Figure 4:
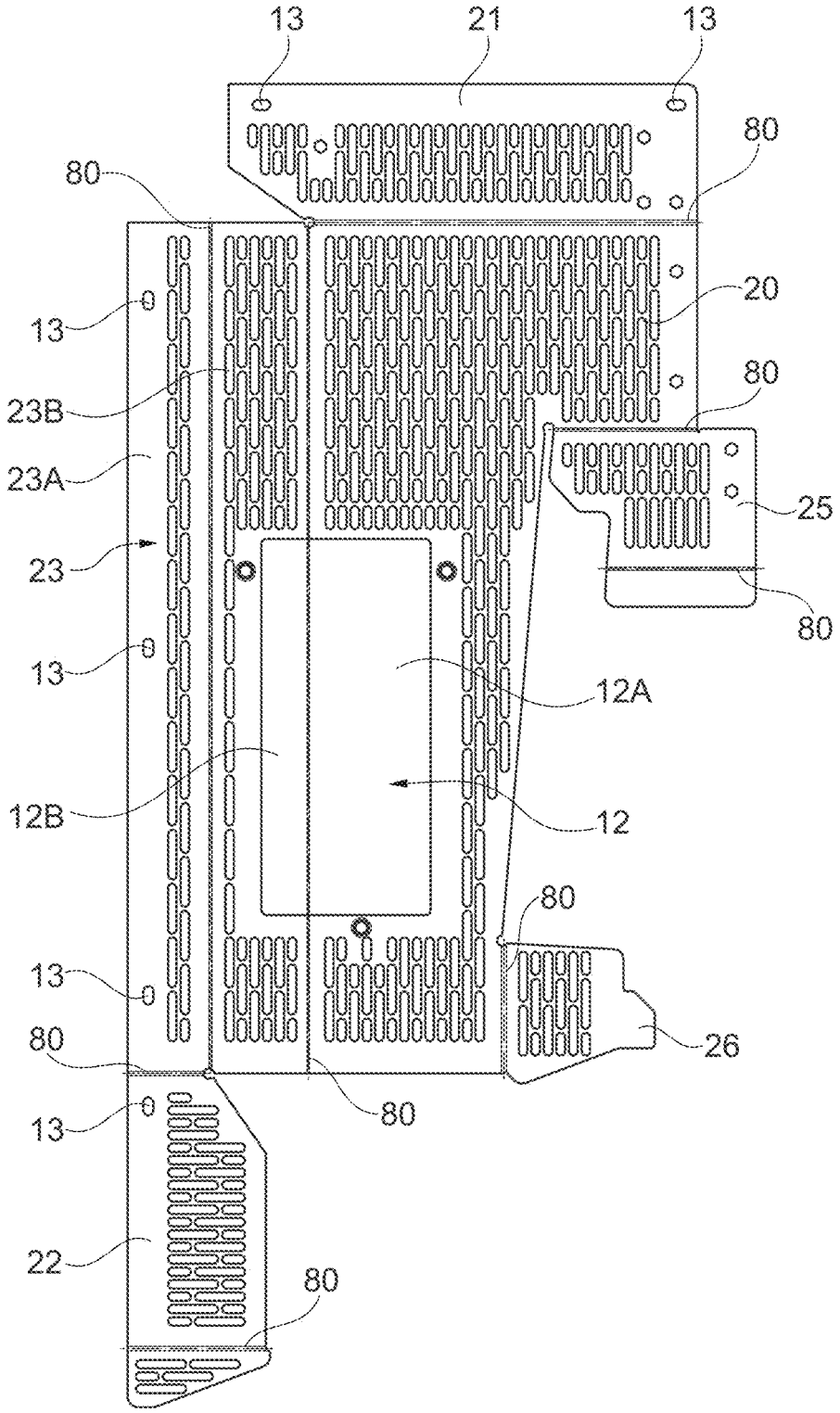
FIG. 4 is a view of a net for forming the first part of the radiator guard of FIG. 1.

FIG. 4 shows a net for forming the first part 10A of the main body 10 of the radiator guard 1. The net may be planar. The mesh material of the net may be, for example, flat rolled mild steel.

The net comprises the service aperture 12. At least one fold line may pass through the service aperture 12.

Forming the first part 10A of the main body 10 of the radiator guard 1 may comprise folding the net about a plurality of fold lines 80 and optionally welding the net to form the first part 10A of the main body 10 of the radiator guard 1. A plurality of retained fasteners 15 may be attached around a periphery of the service aperture 12. The service panel 50 may also be formed of mesh material and then mounted to the first part 10A using the plurality of retained fasteners 15.

When the main body 10 comprises a first part 10A and a second part 10B, the first part 10A and the second part 10B may each be formed from separate single nets of mesh sheet material.

FIG. 5 illustrates an example of an internal combustion engine assembly 100 comprising an engine block 101, a fan 102, a radiator 60 and the radiator guard 1 as described above.

The radiator guard 1 when mounted over the rear face 61 of the radiator 50 may be interposed between the rear face 61 of radiator 60 and a front end of the engine block 101 of the internal combustion engine.

The main body 10 when mounted over the rear face 61 of the radiator 60 may cover a plurality of fan blades of the fan 102.

Where the main body 10 comprises separate first and second parts 10A, 10B these may be mounted, in use, adjacent one another over the rear face 61 of the radiator 60. The first part 10A and the second part 10B when mounted over the rear face 61 of the radiator 60 may substantially surround a fan shaft of the fan 102.

The internal combustion engine assembly may further comprise one or more conduits 105, optionally cooling circuit conduits, the one or more conduits 105 extending across the main body 10 of the radiator guard 1.

FIGS. 6 to 9 illustrate another embodiment of a radiator guard comprising a main body 10 and a service panel 50. In the following description only the differences between the embodiments will be described. In other respects the design and use of the radiator guard may be as discussed in respect of the previous embodiment. The same reference numerals are used for the same parts.

Figure 6:
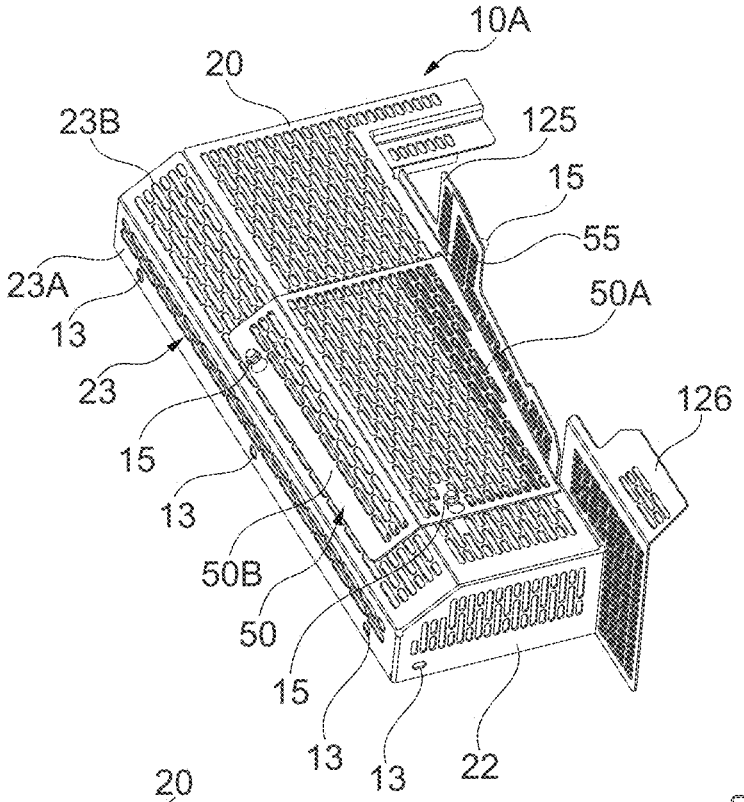
FIG. 6 is a perspective view of an assembly of a first part of a main body of another radiator guard and a service panel according to the present disclosure.
Figure 7:
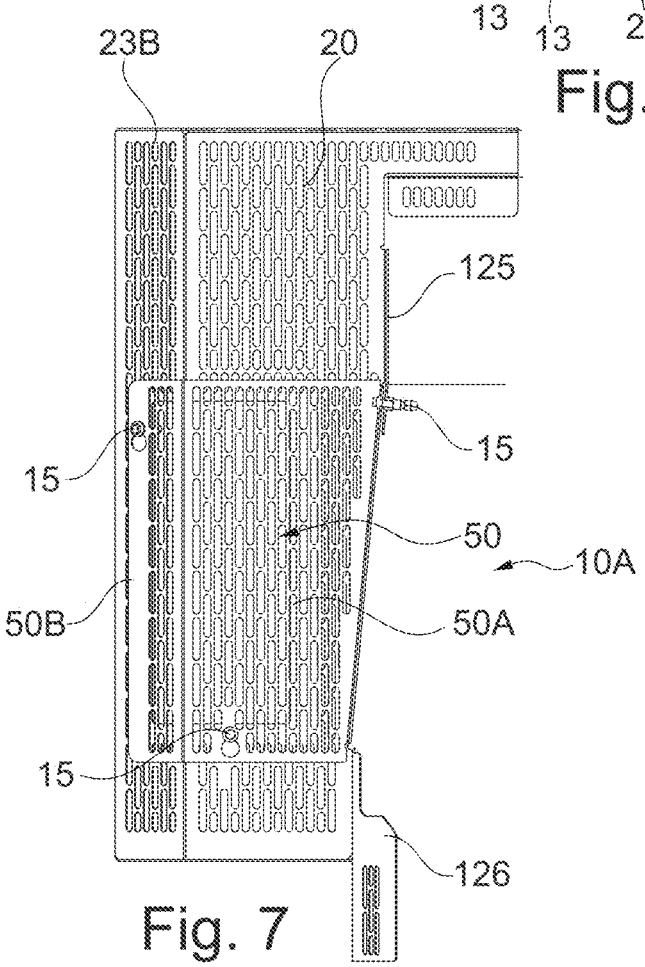
FIG. 7 is a rear view of the assembly of FIG. 6.
Figure 8:
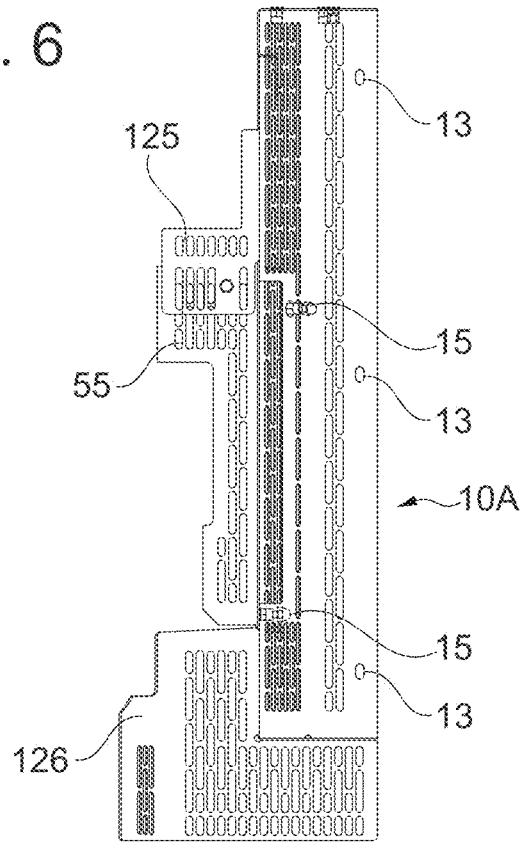
FIG. 8 is a side view of the assembly of FIG. 6.
Figure 9:
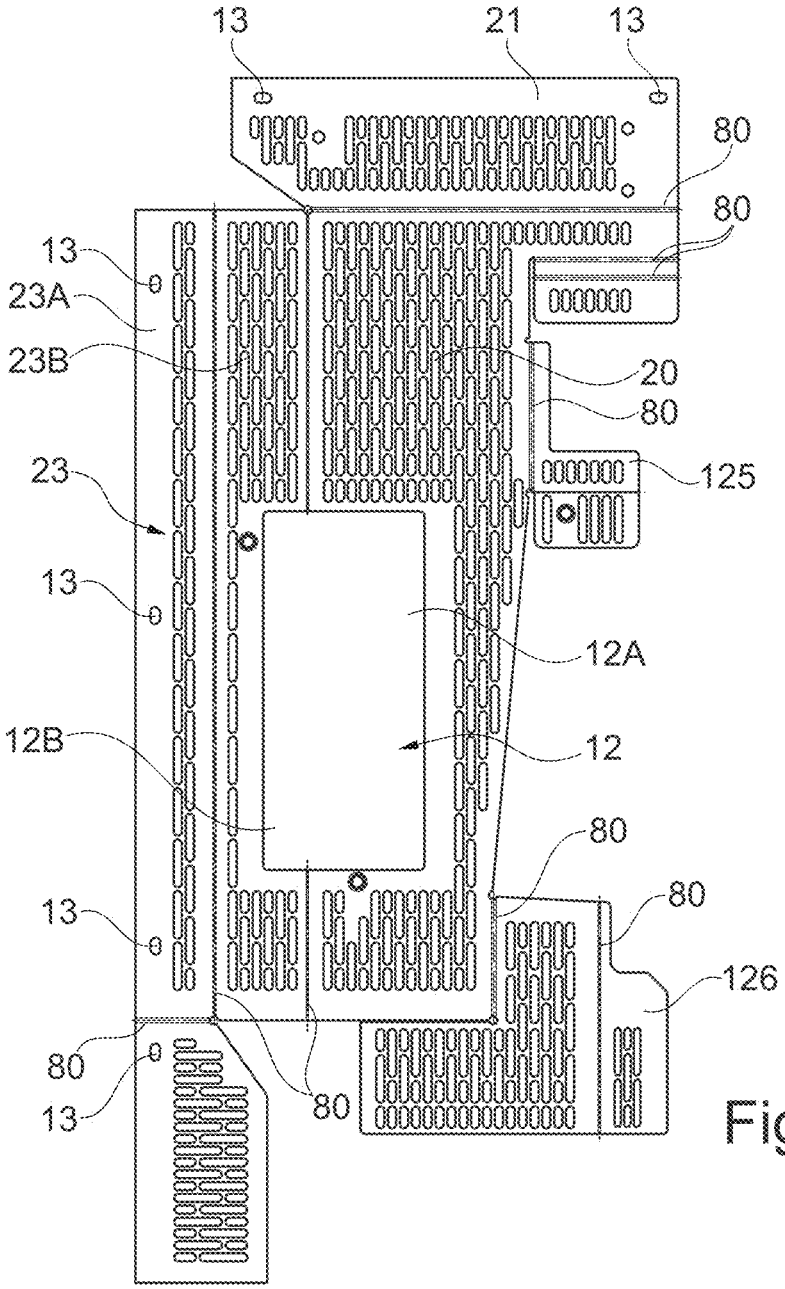
FIG. 9 is a view of a net for forming the first part of the radiator guard of FIG. 6.

The first part 10A of the main body 10 may comprise one or more additional extensions. For example, as shown in FIGS. 6 to 8, one or more lateral flanges may extend from an edge of the rear face 20. The lateral flange(s) may extend perpendicular to the rear face 20. The lateral flange(s) may extend from the rear face 20 in the opposite direction to the direction of extension of the side wall 23 from the rear face 20. A first lateral flange 125 may form a first wall structure to guard against access from the side. A second lateral flange 126 may form a second wall structure to guard against access from the side.

The service panel 50 may also comprise a lateral flange 55. The lateral flange 55 may extend perpendicular to the rear face portion 50A. The lateral flange 55 may extend from the rear face portion 50A generally in the opposite direction to the direction of extension of the side wall portion 50B from the rear face portion 50A. In use, the lateral flange 55 of the service panel 50 when mounted may abut the first lateral flange 125 and/or the second lateral flange 126 of the first part 10A of the main body 10. One or more retainable fasteners 15 may be provided to connect the lateral flange 55 of the service panel 50 to one or more of the lateral flanges 125, 126 of the first part 10A of the main body 10.

INDUSTRIAL APPLICABILITY

The present disclosure provides a radiator guard comprising a main body and a service panel;

the main body being formed of mesh sheet material and comprising:

a plurality of fastening points for mounting the main body over a rear face of a radiator of an internal combustion engine;

a service aperture for providing access, in use, to the rear face of the radiator; and a plurality of retained fasteners arranged around a periphery of the service aperture;

wherein the service panel is releasably mountable to the main body, to cover the service aperture, using the retained fasteners.

Advantageously, the provision of the service aperture and service panel may improve access to the rear face of the radiator and at the same time may reduce the time and difficulty in carrying out servicing and repair to the radiator. Further, the radiator guard of the present disclosure may prevent the need to fully remove/dismount the radiator guard, or a major part of it, from the radiator to allow access to the rear face of the radiator and other components.

Advantageously, the use of retained fasteners for mounting the service panel may allow for very fast and straightforward access to the rear face of the radiator. Access may be toolless, or may only require readily available tools such as a hex key or spanner. Use of retained fasteners advantageously may avoid the risk of parts becoming detached and lost within the interior of the internal combustion engine when accessing the rear race of the radiator.

Advantageously, the radiator guard of the present disclosure may maintain a sufficient structural strength while being formed from mesh sheet material. Advantageously the use of mesh sheet material may allow the radiator guard to have a lower weight, improving its manual handling characteristics and material costs. The radiator guard may also be formed from rolled material and may be formed from a net of sheet material that may then only require folding and optionally welding. This may reduce the cost of manufacture compared to radiator guards that require cast or machined components.

Importantly, the provision of the service panel may avoid the need to disassemble and/or dismount other components of the internal combustion engine when accessing the radiator. For example, the cooling circuit may typically have cooling conduits passing in close proximity to the rear face of the radiator. Other components, for example a shunt tank or mounting brackets, may be located in close proximity to the radiator. Use of the service panel may avoid the need to break the cooling circuit or remove the shunt tank or mounting brackets greatly reducing the time and difficulty and expense of servicing and maintaining the radiator and other components of the internal combustion engine.

Use of mesh sheet material for the main body may improve air flow and reduce noise and weight.

The main body may be sized and dimensioned to cover, in use, a plurality of fan blades of a fan of the internal combustion engine.

The main body may comprise separate first and second parts that can be mounted, in use, adjacent one another over the rear face of the radiator, the first part and the second part being individually dismountable.

The first part and the second part may be mountable around a fan shaft of the internal combustion engine.

The main body may comprise a rear face, a top wall, a bottom wall, and at least one side wall;

wherein the service aperture may encompass a rear face aperture in the rear face and a side wall aperture in the side wall; and the service panel may comprise a rear face portion releasably mountable over the rear face aperture and a side wall portion releasably mountable over the side wall aperture.

Advantageously, the service panel and service aperture extending into the side wall may improve access to the radiator from the side, i.e. in a direction parallel to the plane of the rear face of the radiator. This may improve access where components of the internal combustion engine may be located close and in line with the rear face of the radiator.

The rear face aperture and the side wall aperture may consist of a single aperture.

The side wall may comprise a perpendicular first face angled perpendicularly to the rear face and a canted second face that is canted relative to the rear face and the first face, wherein the side wall aperture is in the canted second face and the side wall portion of the service panel is canted relative to the rear face portion.

At least one of the retained fasteners may be located on the canted second face and at least one, optionally at least two, retained fastener may be located on the rear face.

The service panel may be formed of mesh sheet material. Use of mesh sheet material for the service panel may improve air flow and reduce noise and weight.

The present disclosure also provides an internal combustion engine assembly, comprising:

an engine block a fan a radiator and a radiator guard;

the radiator guard comprising a main body and a service panel;

the main body being formed of mesh sheet material and comprising:

a plurality of fastening points for mounting the main body over a rear face of the radiator;

a service aperture for providing access, in use, to the rear face of the radiator; and a plurality of retained fasteners arranged around a periphery of the service aperture;

wherein the service panel is releasably mountable to the main body, to cover the service aperture, using the retained fasteners.

The radiator guard when mounted over the rear face of the radiator may be interposed between a rear face of radiator and a front end of an engine block of the internal combustion engine.

The main body when mounted over the rear face of the radiator may cover a plurality of fan blades of the fan.

The main body may comprise separate first and second parts that can be mounted, in use, adjacent one another over the rear face of the radiator.

The first part and the second part when mounted over the rear face of the radiator may substantially surround a fan shaft of the fan.

The internal combustion engine assembly may further comprise one or more conduits, optionally cooling circuit conduits, the one or more conduits extending across the main body of the radiator guard.

The service panel may be formed of mesh sheet material.

The present disclosure also provides a method of forming the radiator guard described above, comprising:

forming a net of mesh sheet material, the net comprising the service aperture;

folding and optionally welding the net to form at least a part of the main body of the radiator guard;

attaching a plurality of retained fasteners around a periphery of the service aperture;

forming the service panel of mesh material; and mounting the service panel to the at least a part of the main body using the plurality of retained fasteners.

The main body may comprise a first part and a second part and the first part and the second part may each be formed from separate single nets of mesh sheet material.

Folding the main body net may comprise forming at least one fold that passes through the service aperture.

Forming the service panel may comprise folding the service panel to form a rear face portion and a side wall portion that are angled relative to each other.

It is to be understood that at least some of the figures and descriptions of the disclosure have been simplified to focus on elements that are relevant for a clear understanding of the disclosure, while eliminating, for purposes of clarity, other elements that the reader skilled in the art will appreciate may also be required. Because such elements are well known to the reader skilled in the art, and because they do not necessarily facilitate a better understanding of the disclosure, a description of such elements is not provided herein.

What is claimed is:

1. A radiator guard comprising a main body and a service panel;

the main body being formed of mesh sheet material and comprising:

a plurality of fastening points for mounting the main body over a rear face of a radiator of an internal combustion engine;

a service aperture for providing access, in use, to the rear face of the radiator; and a plurality of retained fasteners arranged around a periphery of the service aperture;

wherein the service panel is releasably mountable to the main body, to cover the service aperture, using the retained fasteners.

2. The radiator guard of claim 1, wherein the main body is sized and dimensioned to cover, in use, a plurality of fan blades of a fan of the internal combustion engine.

3. The radiator guard of claim 1, wherein the main body comprises separate first and second parts that can be mounted, in use, adjacent one another over the rear face of the radiator, the first part and the second part being individually dismountable.

4. The radiator guard of claim 3, wherein the first part and the second part are mountable around a fan shaft of the internal combustion engine.

5. The radiator guard of claim 1, wherein the main body comprises a rear face, a top wall, a bottom wall, and at least one side wall;

wherein the service aperture encompasses a rear face aperture in the rear face and a side wall aperture in the side wall; and the service panel comprises a rear face portion releasably mountable over the rear face aperture and a side wall portion releasably mountable over the side wall aperture.

6. The radiator guard of claim 5, wherein the rear face aperture and the side wall aperture consist of a single aperture.

7. The radiator guard of claim 5, wherein the side wall comprises a perpendicular first face angled perpendicularly to the rear face and a canted second face that is canted relative to the rear face and the first face, wherein the side wall aperture is in the canted second face and the side wall portion of the service panel is canted relative to the rear face portion.

8. The radiator guard of claim 7, wherein at least one of the retained fasteners is located on the canted second face and at least one, retained fastener is located on the rear face.

9. The radiator guard of claim 1, wherein the service panel is formed of mesh sheet material.

10. An internal combustion engine assembly, comprising:

an engine block;

a fan;

a radiator; and a radiator guard;

the radiator guard comprising a main body and a service panel;

the main body being formed of mesh sheet material and comprising:

a plurality of fastening points for mounting the main body over a rear face of the radiator;

a service aperture for providing access, in use, to the rear face of the radiator; and a plurality of retained fasteners arranged around a periphery of the service aperture;

wherein the service panel is releasably mountable to the main body, to cover the service aperture, using the retained fasteners.

11. The internal combustion engine assembly of claim 10, wherein the radiator guard when mounted over the rear face of the radiator is interposed between a rear face of radiator and a front end of an engine block of the internal combustion engine.

12. The internal combustion engine assembly of claim 10, wherein the main body when mounted over the rear face of the radiator covers a plurality of fan blades of the fan.

13. The internal combustion engine assembly of claim 10, wherein the main body comprises separate first and second parts that can be mounted, in use, adjacent one another over the rear face of the radiator.

14. The internal combustion engine assembly of claim 13, wherein the first part and the second part when mounted over the rear face of the radiator substantially surround a fan shaft of the fan.

15. The internal combustion engine assembly of claim 10, further comprising one or more conduits, the one or more conduits extending across the main body of the radiator guard.

16. The internal combustion engine assembly of claim 10, wherein the service panel is formed of mesh sheet material.

17. A method of forming the radiator guard of claim 1, comprising:

forming a net of mesh sheet material, the net comprising the service aperture;

folding the net to form at least a part of the main body of the radiator guard;

attaching a plurality of retained fasteners around a periphery of the service aperture;

forming the service panel of mesh material; and mounting the service panel to the at least a part of the main body using the plurality of retained fasteners.

18. The method of claim 17, wherein the main body comprises a first part and a second part and the first part and the second part are each formed from separate single nets of mesh sheet material.

19. The method of claim 17, wherein folding the main body net comprises forming at least one fold that passes through the service aperture.

20. The method of claim 17, wherein forming the service panel comprises folding the service panel to form a rear face portion and a side wall portion that are angled relative to each other.

* * * * *